US011035158B2

(12) United States Patent
Bendel

(10) Patent No.: US 11,035,158 B2
(45) Date of Patent: Jun. 15, 2021

(54) LOCK HOLDER FOR A MOTOR VEHICLE LOCK

(71) Applicant: Kiekert AG, Heiligenhaus (DE)

(72) Inventor: Thorsten Bendel, Oberhausen (DE)

(73) Assignee: Kiekert AG, Heiligenhaus (DE)

( * ) Notice: Subject to any disclaimer, the term of this patent is extended or adjusted under 35 U.S.C. 154(b) by 412 days.

(21) Appl. No.: 15/756,078

(22) PCT Filed: Aug. 16, 2016

(86) PCT No.: PCT/DE2016/100367
§ 371 (c)(1),
(2) Date: Feb. 28, 2018

(87) PCT Pub. No.: WO2017/036446
PCT Pub. Date: Mar. 9, 2017

(65) Prior Publication Data

US 2018/0252008 A1 Sep. 6, 2018

(30) Foreign Application Priority Data

Aug. 28, 2015 (DE) ..... 10 2015 114 357.7

(51) Int. Cl.
*E05B 85/04* (2014.01)
*E05B 15/02* (2006.01)

(52) U.S. Cl.
CPC ..... *E05B 85/04* (2013.01); *E05B 15/0205* (2013.01); *E05B 15/0295* (2013.01);
(Continued)

(58) Field of Classification Search
CPC ..... Y10T 292/68; Y10T 292/685; Y10T 292/694; E05B 85/04; E05B 85/045; E05B 15/0205; E05B 15/0295
See application file for complete search history.

(56) References Cited

U.S. PATENT DOCUMENTS 1,974,682 A * 9/1934 Margoshes ..... G09F 3/00 40/317
4,136,598 A * 1/1979 Hughes ..... F16B 37/14 411/372

(Continued)

FOREIGN PATENT DOCUMENTS

DE 43 06 151 C2 9/1994
DE 199 43 083 C2 4/2001

(Continued)

OTHER PUBLICATIONS

International Search Report and Written Opinion for corresponding Patent Application No. PCT/DE2016/100367 dated Nov. 11, 2016.

*Primary Examiner* — Carlos Lugo
(74) *Attorney, Agent, or Firm* — Renner, Otto, Boisselle & Sklar, LLP

(57) ABSTRACT

A lock holder for a motor vehicle lock includes a locking bolt and a mounting plate, wherein the locking bolt can be fastened together with the mounting plate to a motor vehicle body, a cover cap, wherein at least the mounting plate can be covered at least in areas by the covering cap, and wherein the covering cap can be connected in such a way to the mounting plate that the cover cap forms at least in regions a surface area with the mounting plate.

17 Claims, 4 Drawing Sheets

(52) U.S. Cl.
CPC ..... *E05B 85/045* (2013.01); *Y10T 292/68* (2015.04); *Y10T 292/685* (2015.04); *Y10T 292/694* (2015.04)

(56) References Cited

U.S. PATENT DOCUMENTS 4,192,039 A * 3/1980 Haberle ..... B60J 5/101 16/86 B
4,470,626 A * 9/1984 Gergoe ..... E05B 85/045 292/341.12
4,621,230 A * 11/1986 Crouch ..... B25B 9/00 292/307 B
4,650,231 A * 3/1987 Shimura ..... E05B 85/045 292/340
4,981,313 A * 1/1991 Makamura ..... E05B 85/045 292/340
5,215,342 A 6/1993 Yuge et al.
5,494,324 A * 2/1996 Kleefeldt ..... E05B 85/045 292/216
5,529,356 A * 6/1996 Cetnar ..... E05B 85/045 292/340
6,213,296 B1 * 4/2001 Streich ..... A45C 5/00 206/373
6,230,366 B1 * 5/2001 Lin ..... A45C 13/26 16/431
6,631,933 B1 10/2003 Westerwick
6,883,842 B2 * 4/2005 Paskonis ..... E05B 85/045 292/340
8,944,479 B2 * 2/2015 Muramatsu ..... E05B 77/36 16/82
9,016,733 B2 * 4/2015 Fath ..... E05B 13/002 292/163
9,121,205 B2 * 9/2015 Muramatsu ..... E05B 77/36
2007/0262595 A1 * 11/2007 Johnson ..... E05B 85/045 292/340
2012/0112477 A1 5/2012 Muramatsu et al.
2013/0047374 A1 * 2/2013 Muramatsu ..... E05C 17/54 16/82
2014/0070546 A1 3/2014 Muramatsu et al.

FOREIGN PATENT DOCUMENTS

DE 10011313 A1 * 9/2001 ..... E05B 15/0205
DE 102015116773 A1 * 4/2017 ..... E05B 85/04
EP 502825 A1 * 9/1992
EP 566541 * 10/1993
EP 894918 * 2/1999
EP 918123 A2 * 5/1999
EP 1134334 A1 * 9/2001 ..... E05B 85/045
EP 1182311 A1 * 2/2002 ..... E05B 85/045
EP 2 562 332 A2 2/2013
GB 2110751 A * 6/1983 ..... E05C 3/043
GB 2 275 498 A 8/1994
JP H02 36573 U 3/1990
JP 05086752 A * 4/1993 ..... E05B 81/66
JP 2612787 B2 * 5/1997
WO WO-2017036446 A1 * 3/2017 ..... E05B 85/04

* cited by examiner

LOCK HOLDER FOR A MOTOR VEHICLE LOCK

FIELD OF INVENTION

The invention relates to a striker for a motor vehicle latch, having a locking bolt and a mounting plate, whereby the locking bolt can be attached to a motor vehicle chassis together with the mounting plate and a cover cap, whereby at least the mounting plate can be covered at least partially by means of the cover cap.

BACKGROUND OF INVENTION

Strikers are preferably used where moving components on motor vehicles interact with a latching system. Doors, flaps, hoods, sliding doors, compartments or covers can be classed as moving components, whereby the moving components themselves or the motor vehicle can accommodate the motor vehicle latch or the striker. This means that the accommodation of the striker is not compulsorily connected to the motor vehicle chassis, but the striker can alternatively also be located on the moving component, such as a flap, for example.

The locking bolt interacts directly with the motor vehicle latch. A motor vehicle latch usually has a catch and at least one pawl which together form a locking mechanism. Locking bolts are generally known and are used in the motor vehicle in different embodiments. The invention is not restricted to a special embodiment of the locking bolt, but encompasses all designs which can be attached to the motor vehicle chassis by means of a mounting plate. The striker can be executed as a cylindrical bolt, a bracket or an angle, for example. A striker executed with a bracket-shaped locking bolt has become known from DE 43 06 151 C2. The striker is curved from a steel sheet as a single component and has a plastic coating, at least in the area of the mounting plate. The fixing flanges on the mounting plate have areas in the sheet steel which extend to the contact surface of the mounting plate on the motor vehicle chassis so that bracing elements are formed.

A striker also executed with a bracket-shaped locking bolt has become known from DE 199 43 083 C2. The locking bolt is attached to a mounting plate in a U-shape, whereby the locking bolt is coated with a black plastic except for the engagement area of the catch of the motor vehicle door latch. The mounting plate of the striker can also have a cover cap on its side turned away from the motor vehicle chassis. The design of the cover cap is such that it can be clipped onto the mounting plate. Thus, in contrast, a striker which is otherwise generally manufactured from chrome-plate steel and consequently only metallically shiny realizes an embodiment in which the cover cap is executed as part of a visible area of the striker. The cover cap is pushed over the edge of the mounting plate and clipped onto the mounting plate.

A problem arising in the development of strikers and in particular strikers with cover caps is that the cover caps must be securely connected to the striker at all times. It can thus occur, for example, that a striker arranged in the boarding area of a motor vehicle is stressed impulsively by a person and/or an object, such as a bag. In such a case too, a secure connection must be guaranteed between the cover and the striker. Furthermore, the automotive industry constantly strives to improve the esthetic appearance of a motor vehicle. Hereby, specifications regarding a lighter weight, greater functionality, esthetic appearance and safety must be considered and complied with.

SUMMARY OF INVENTION

The object of the invention is to provide an improved striker. Furthermore, it is an object of the invention to provide a striker with which the highest degree of safety is attained and in which a proper connection can be attained between a cover cap and the mounting plate at all times. Furthermore, an object of the invention is to provide a structurally simple and cost-effective option to connect a cover cap to a striker or a mounting plate.

According to the invention, the object is solved by the characteristics of the present application. Advantageous embodiments of the invention are described herein. It is pointed out that the embodiments described hereafter are not restrictive; instead, any variations are possible of the characteristics described in the description.

The object of the invention is solved by a striker being provided for a motor vehicle latch having a locking bolt and a mounting plate, whereby the locking bolt can be attached to a motor vehicle chassis together with the mounting plate, a cover cap, whereby by means of the cover cap at least the mounting plate can be covered at least in places and whereby the cover cap can be connected to the mounting plate in such a way that the cover cap forms a surface area, at least in places, in particular together with the mounting plate. Due to the formation of the striker according to the invention, the possibility is now given of providing the highest degree of safety in the area of the striker. Protruding edges and thus engagement areas can be dispensed with for an operator in particular by the cover cap forming a surface area together with the mounting plate so that an operator of the motor vehicle is faced with an even surface which, in turn, prevents the risk of injury whilst guaranteeing a secure connection between the cover cap and the mounting plate.

A striker can be used everywhere where moving, pivoting, sliding or for example, cover caps are used in a motor vehicle. The striker encompasses at least one locking bolt used with a latch, in particular a motor vehicle latch, such as a lateral door latch. The locking bolt of the striker interacts with the latch of the motor vehicle, whereby a catch preferably engages with the locking bolt and forms a detachable connection with the locking bolt. The invention relates to such locking bolts or strikers which are equipped with a mounting plate. The purpose of the mounting plate is to cover an attachment area of the striker and/or to hold the locking bolt itself. Locking bolts can be used which are directly connected to the motor vehicle chassis and also locking bolts which are connected to the mounting plate. A connection between the locking bolt and the latch plate can be made in such a way that the locking bolt can be connected to the latch plate; however, the locking bolt can also be formed as a single component with the latch plate. The invention is not restricted to the cylinder pin design but can have different shapes and geometries. The locking bolt is preferably of a cylindrical design in the engagement area of the motor vehicle latch and in particular the catch. However, if the locking bolt is a U-shaped locking bolt, for example, further areas of the locking bolt can be of a cylindrical and/or square design. Furthermore, the use of locking bolts of an angular design is also conceivable. The mounting plate can also be of an angular design for this purpose, for example so that it encompasses a mounting surface and a splay protruding, for example, at a right angle from the mounting surface. The angular mounting plate and also the angular locking bolt can either be formed as a single component or connected as separate components so that a striker having one opening is formed.

The mounting plate or the striker is attached to the motor vehicle. The striker can either be attached to the motor vehicle frame or be located on the moving component of the motor vehicle chassis, such as a lateral door or a sliding door. The striker is preferably connected to the motor vehicle chassis by means of a screw connection. The striker is preferably connected to the motor vehicle chassis by means of a screw connection and even more preferably by means of two screw connections. In even further preferred embodiments, more than two screw connections are also conceivable on the striker.

The invention report proposes connecting cover caps with the mounting plate in such a way as to cover the screw connection that the cover caps form a common surface with the mounting plate at least in places. The design of the striker in the shape that the cover cap and the mounting plate has a common surface with a contour which concurs at least in places offers the advantage that on the one hand an esthetic appearance of the striker can be attained and, simultaneously, a smooth surface is available to the motor vehicle operator which on the one hand prevents injury to the operator and furthermore forms no attack surfaces for objects passing the striker. The striker thus forms an integral unit in combination with the cover cap. The cover cap can only cover the mounting plate in places, the cover cap covers the mounting area of the mounting plate but at least as far as the fasteners used for mounting are covered.

A cover cap can be provided which covers a fastener for the striker, for example. However, according to the invention it is also possible that two, three and more cover caps are used to cover the fasteners of the striker. The design of a cover cap can be such that several fasteners are covered. The cover cap can also form a cover cap solely covering several uniform fasteners, whereby the cover cap itself can be formed of two or multiple components. This means that the cover cap covers a surface in relation to the mounting plate which extends beyond the mounting plate and covers a correlating surface, whereby the cover cap itself does not necessarily need to be formed as a single component itself. Instead, it is also conceivable for the cover cap to be formed from two components, for example. A dual or multiple component structure of the cover cap can advantageously facilitate mounting of the cover cap.

In one embodiment of the invention an advantage then results if the cover cap ends flush, at least in places, with a surface area of the mounting plate. Flush ending of the cover cap with the mounting plate surface enables facilitated mounting of the cover cap, for example. Advantageously, an operator who mounts the cover cap on the mounting plate can ascertain proper mounting solely by the haptic feedback of a flush contact surface of the cover cap. The cover cap and the mounting plate preferably form a surface of the striker. If the cover cap is engaged into the surface of the striker or the mounting plate such that the cover cap ends flush with a surface area of the mounting plate, even surfaces can thus be attained and a high-quality appearance attained simultaneously. In particular by means of the flush ending and preferably a gap-free insertion of the cover cap into the mounting plate of the striker a high-quality appearance can be attained. In addition to the high-quality appearance, a flush ending of the cover cap with the mounting plate gives the advantage that dirt and/or moisture cannot penetrate into the fastener area. The fastener is preserved and cleaning of the striker facilitated as a result.

If the cover cap ends circumferentially flush with a surface area of the mounting plate, a further advantageous embodiment of the invention thus results. If the cover cap is formed in such a way that the circumference of the cover cap ends with the mounting plate and ends in particular without a transition, an insert element can be advantageously formed for the striker. An insert element forms an integral component of the striker surface with a circumferentially flush contact surface between the cover cap and the mounting plate. If a surface area of the mounting plate is referred to in conjunction with the invention, the surface is preferably described which faces the operator of the motor vehicle or which faces the contact surface of the mounting plate on the chassis. In other words, the visible surface area of the striker is described which is visible to the motor vehicle user when operating the motor vehicle. The cover cap cannot end circumferentially with a surface area of the mounting plate if the cover cap is not completely enveloped by a surface area of the mounting plate. Thus, for example, the cover cap can also form a final area of the mounting plate so that a peripheral area of the mounting plate is formed on the one hand from the mounting plate and on the other hand from the cover cap.

In a further advantageous embodiment of the invention, a surface area of the cover cap has a depression, in particular a depression in relation to a surface area of the mounting plate. A depression in a surface area of the cover cap can fulfil esthetic claims on the one hand; however, a depression can also have a functional purpose so that functional elements which interact with the locking bolt, for example, can be introduced very close to the mounting plate. If one or two or several depressions in the cover cap fulfil functional requirements on the one hand, it is also conceivable to use the depressions for the insertion of signs, brands, symbols and/or figures in order to only state usage options for insertion into the depressions as an example. In addition to the accommodation of trademarks, for example, into the depressions, it is also conceivable that safety information, for example, such as alphanumerical characters are stated there so that information on tire pressure can be inserted into the depression. It is naturally conceivable according to the invention that one, two or more depressions can be inserted into one, two or more cover caps of a striker.

If the mounting plate can be mounted by means of at least one fastening means onto a motor vehicle chassis and the cover cap can be connected with the fastener in a form-fitting and/or force-fitting manner, a further advantageous embodiment of the invention results. Advantageously the striker can be mounted to the motor vehicle chassis by means of a fastener and preferably by means of a screw connection. As already explained above, the fixing of the striker is not compulsorily connected to the chassis frame, but can also be mounted on flaps, glove compartments or sliding doors. A screw of the fastener constitutes an exemplary embodiment. Whether countersunk screws or other embodiments are used is not crucial to the invention; within the scope of this embodiment, it is advantageous if the cover cap is directly connected to the fastener itself. It is advantageous if no separate fasteners need to be formed for the cover cap as the fastener itself provides a means for fastening the cover cap.

The cover cap can be inserted into the fastener in one embodiment. If the fastener is a screw with an opening for an internal hex, for example, the cover can thus be inserted into the opening of the square of the fastener. The internal hex then acts as a retainer for the cover cap. If, in this regard, the cover cap is flushly inserted into a surface area of the mounting plate, a guide can be provided during mounting of the cover cap by means of the opening in the mounting plate. In contrast, the opening in the fastener can act as a holder for the cover cap.

A further embodiment results if the cover can be connected to the mounting plate in a form-fitting and/or force-fitting manner. If the mounting plate itself is used to hold the cover cap, additional holders for the cover cap can thus be dispensed with. This form of the fastener forms a cost-effective and structurally simple option of a design for inserting the cover cap into the mounting plate. In order to produce a force-fitting connection between the cover cap and the mounting plate, for example, only a suitable tolerance must be executed between the two components in order to guarantee holding of the cover cap.

In a further embodiment, the cover cap can be inserted and/or clipped into the mounting plate. Insertion of the cover cap into the mounting plate offers several advantages simultaneously. Incorrect installation of the cover cap can be prevented by means of insertion due to clear alignment of the cover cap in relation to the mounting plate. An inserted cover cap can also be dismantled especially easily. Secure mounting and attachment of the cover cap on or to the striker can be guaranteed in particular in a combination of an insertable cover cap and a cover cap which can be ratcheted in. Secure mounting can take place, for example, by firstly pushing in and finally clipping in of the cover cap for final securing of the cover cap. The cover cap is thus guided during mounting and is finally fixed on the striker by means of the clip connection.

If the mounting plate and/or the cover cap has a ratchet, so that ratcheting of the cover cap is enabled, a further advantageous embodiment of the invention results. A ratchet offers the advantage that, in addition to haptic feedback for the installer of the cover cap, acoustic ratcheting can also confirm proper mounting of the cover cap. If, in one embodiment, the cover cap is formed as insertion element into the mounting plates, for example, on the one hand a form-fitting connection can thus enable holding and also a ratchet for fixing the cover cap. In particular from the different attachment and/or connection options between the cover cap and the mounting plate, there are a multitude of options for the secure connection of the cover cap to the mounting plate. It is once again explicitly pointed out that the examples stated here are not restrictive, but that according to the configuration of the striker naturally different configuration forms of the cover plate can cause different holding mechanisms and combinations of the aforementioned connectors between the cover cap and the mounting plate.

In one embodiment of the invention, the striker is made of steel, in particular chrome steel and/or chromium-plated steel and the cover cap is made of plastic, in particular black plastic. Chrome steels and/or chrome-plated steels offer the advantage of an especially smooth and even surface. In the interplay between the smooth surface of the striker and the flush insertion of the cover cap or cover caps an especially smooth, even and thus secure embodiment of a striker thus results. Neither protruding edges nor attack means result for an operator so that injuries caused by protruding edges or surfaces on the striker are almost completely prevented.

If the striker has at least two, in particular symmetrically arranged cover caps, a further advantageous embodiment of the invention thus results. A symmetrical construction of the striker offers the advantage of uniform force absorption by the striker and also uniform transmission of the absorbed force into the motor vehicle chassis. A symmetrical construction of the striker in combination with symmetrical cover caps can thus generate a complete esthetic appearance on the one hand and clarify and emphasize the symmetry of the construction of the striker to the operator on the other hand. Furthermore, the symmetrical construction offers the same components for coverage of the attachment means to the striker which in turn reduces the number of different components required.

Advantageously, the cover cap can form a peripheral area of the striker, at least in places. The cover cap ends with the surface of the striker in places. Furthermore, the cover cap can be designed such that the cover cap can reach into a peripheral area of the chassis component which accommodates the striker. In this case, the cover cap forms a peripheral area of the striker. Consequently, the cover cap is only surrounded circumferentially by the mounting plate in places. The one, two or several cover caps can be formed in such a way that they follow the surface of the mounting plate on their circumference so that surfaces also tilted to the surface of the mounting plate are formed on the cover cap.

If the cover cap forms an integral component of the striker, so that in particular the cover cap forms a uniform surface in interplay with the mounting plate, a further advantageous embodiment of the invention results. As an integral component of the striker, the cover cap can be formed in such a way that a surface following the surface of the striker and in particular the mounting plate is formed. If, for example, the striker and in particular the striker plate is formed in a curved shape following the chassis, the cover cap thus follows the geometrical shape of the striker. The cover cap can consequently also be curved, i.e. have a radius which follows the mounting plate, for example. An integral component can thus be formed by the cover cap following the shape of the mounting plate in relation to the mounting plate surface, and also by the cover cap being formed to one or several peripheral areas of the striker.

If the cover cap has a metallic surface and/or a surface with a metallic appearance, at least in places, a further advantageous embodiment of the invention thus results. If, for example, the striker is made of chrome steel or chrome-plated steel, the operator is faced with a smooth surface which protects from injury and is easy to clean. If the cover cap is now also formed in a shiny metallic surface, similar to chrome for example, the operator is faced with a uniform metallic shining surface. It is also conceivable that the cover cap is also made of chromium-plated plastic. Metallic coating of the plastic can occur by means of a PVD procedure, for example.

BRIEF DESCRIPTION OF DRAWINGS

The invention is described in further detail below with reference to the attached drawings on the basis of preferred embodiments. However, the principle applies that the exemplary embodiments do not restrict the invention, but only constitute advantageous embodiments. The characteristics portrayed can be executed individually or in combination with other characteristics of the description and also the patent claims individually or in combination.

The following are shown.

DETAILED DESCRIPTION OF DRAWINGS

Figure 1:
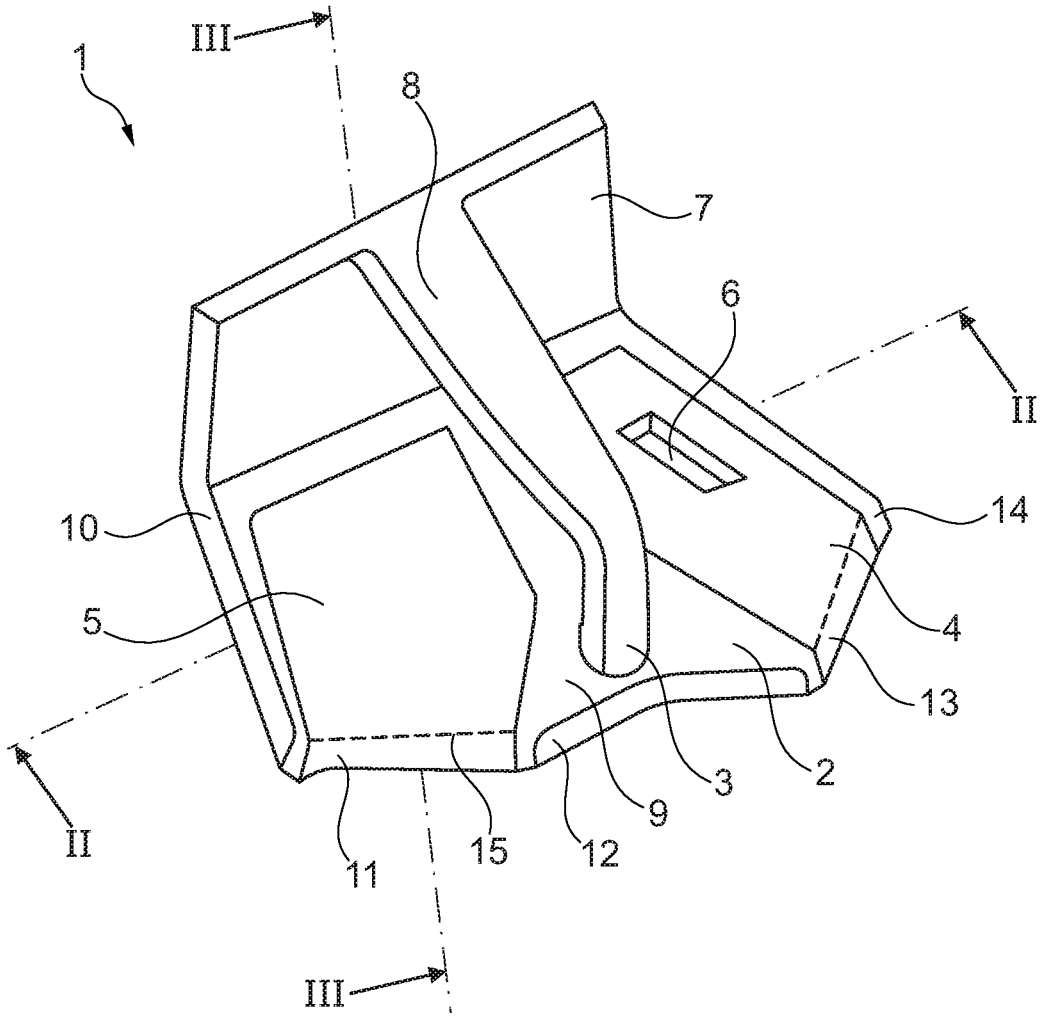
FIG. 1 a three-dimensional view of a first embodiment of a striker with a symmetrical construction and two cover caps, FIG. 2 a cut along the II-II line from FIG. 1 which show the striker in a cross-section from a front view, FIG. 3 a cross-section along line III-III from FIG. 1, which shows the striker in a lateral view, FIG. 4 a further embodiment of a striker in a three-dimensional view with two cover caps integrated into the surface of the mounting plate, FIG. 5 a cut along the V-V line from FIG. 4 which shows the striker in a front view, FIG. 6 a detailed view of an alternative embodiment of a fastener of a cover cap according to an area VI from FIG. 5, and FIG. 7 a further alternative embodiment of a fastener of a cover cap also depicted as an example in an area VII from FIG. 5.

A first embodiment of a striker 1 in a three-dimensional view is reproduced in FIG. 1. The striker 1 has a mounting plate 2, a locking bolt 3, a first cover cap 4 and a second cover cap 5. A depression 6 is molded into the first cover cap 4. A splay 7 is connected to the mounting plate 2 which is executed as a single component with the mounting plate 2 in the present exemplary embodiment. A bracket-shaped strut 8 is connected to the locking bolt 3 which is connected to the splay 7. The locking bolt 3 and the strut 8 are formed as a single component in the present exemplary embodiment. The locking bolt 3 and the strut 8 are undetachably connected with the mounting plate 2 and the splay 7. Alternatively, it is also conceivable to manufacture the locking bolt 3, strut 8, mounting plate 2 and splay 7 as single components.

The first cover cap 4 and the second cover cap 5 are circumferentially adjacent to the surface 9 of the mounting plate 2 in places. Furthermore, the cover caps 4, 5 form a peripheral area of the mounting plate 2, at least in places. As clearly apparent in FIG. 1, the mounting plate 2 has a peripheral area 10, 12, 14, which can be directly applied to a chassis component of a motor vehicle which is not illustrated for the mounting of the striker 1. The first and second cover cap 4, 5 form an integral component of the mounting plate 2 and in particular also an integral component in the peripheral area 11, 13 of the cover caps 4, 5 to complement the peripheral areas 10, 12, 14 of the striker 1. As depicted in particular with the strokes 15 on the cover caps 4, 5, the cover caps 4, 5 follow the shape of the surface 9 of the mounting plate 2. The first and second cover caps are largely formed evenly with the surface 9 of the mounting plate 2 in this exemplary embodiment. However, in the wall area 11, 13 they are angular, so that a uniform peripheral area 10, 11, 12, 13, 14 of the striker 1 is formed.

A logo of an automotive manufacturer can be inserted into the depression 6, for example, so that the first cover cap 4 which is also equipped with a logo forms a flush and even surface with the surface 9 of the mounting plate 2.

Figure 2:
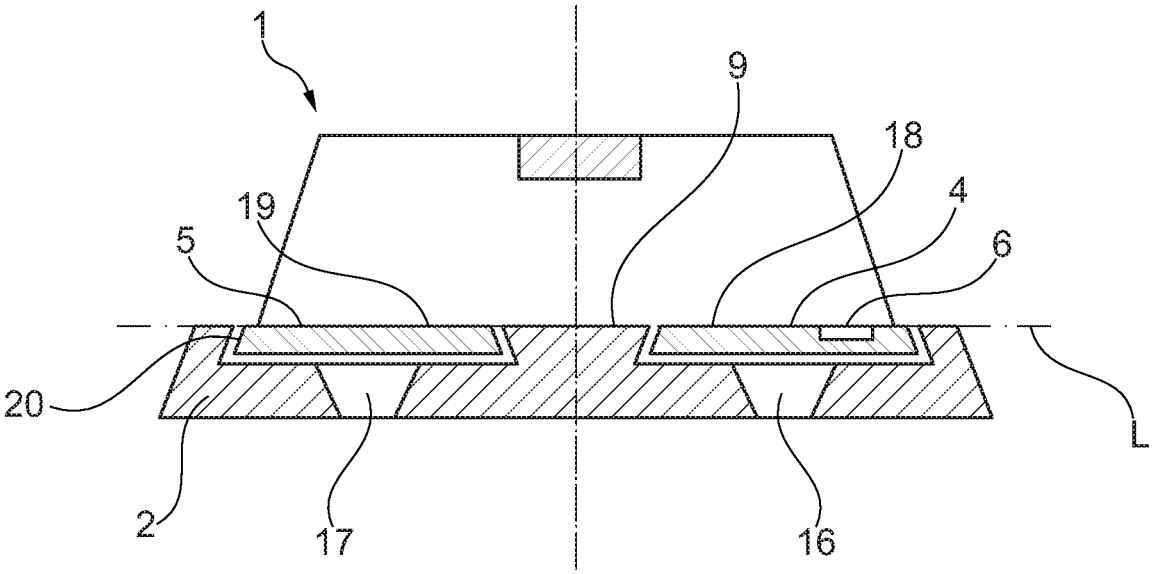

A cut along line II-II by the striker 1 is reproduced in FIG. 2. The same components are furnished with the same reference figures. As clearly apparent in the cut in FIG. 2, the first and second cover caps 4, 5 for coverage of the mounting openings 16, 17 can be inserted into the non-illustrated countersunk screws, for example, in order to attach the striker 1 to a chassis of a motor vehicle. Furthermore, a line L is marked in FIG. 2 which makes clear that the cover caps 4, 5 form an even surface with the surface 9 of the mounting plate 2. The surfaces 18, 19 of the cover caps 4, 5 form a flush plane along line L uniform with the surface 9 of the mounting plate.

As also clearly apparent in FIG. 2, a symbol, a sign or an indicator can be inserted into the depression 6 of the cover cap 4 which can also be mounted flush with the surface 18 of the cover cap 4 due to the depression 6 in the first cover cap 4. The striker 1 thus offers the advantage that the operator of the motor vehicle is faced with a plane and a smooth surface.

The first and second cover cap 4, 5 is at least partially inserted into the mounting plate 2 according to the exemplary embodiment. A form-fitting connection in the form of an undercut 20 is provided for in the mounting plate 2 to attach the first and second cover cap 4, 5. The cover caps 4, 5 have a profile which cooperates with the undercut 20 which is inserted into the undercut 20 and thus fixes the cover caps 4, 5 securely to the mounting plate 2 or the striker 1.

Figure 3:
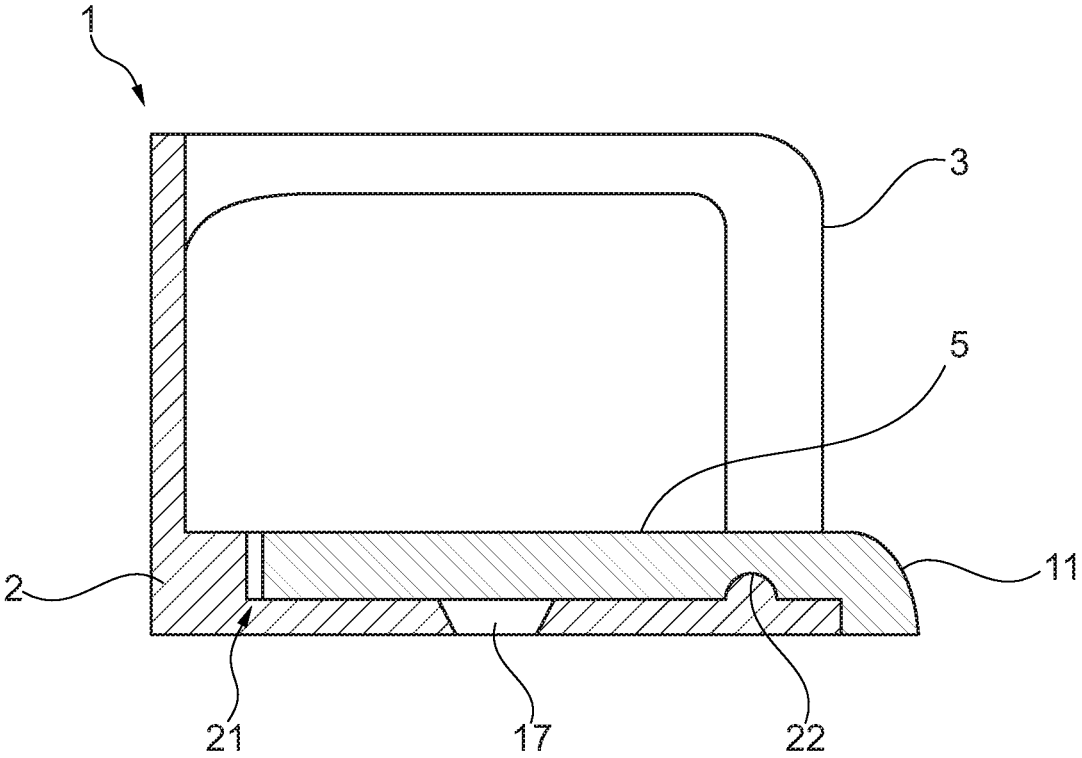

A cut along line HI-Ill from FIG. 1 is reproduced in FIG. 3. The peripheral area 11 of the striker 1 or the mounting plate 2 formed by means of the second cover cap 5 is apparent. It is also apparent that the mounting plate 2 and the cover cap 5 are adjacent with a welt 21. This means that the form-fitting connection between the cover caps 4, 5 and the mounting plate 2 do not absolutely need to be formed fully. For the further fixing of the cover caps 4, 5 the striker 1 has a ratchet means 22 which, in this exemplary embodiment, is formed as an elevation in the mounting plate 2 and from a depression in the cover cap 4, 5. The elevation and the depression form the ratchet means which ratchets in as soon as the cover cap 4, 5 is completely inserted into the mounting plate 2 of the striker 1. The attachment of the cover caps 4, 5 to the striker 1 thus occurs in this exemplary embodiment from a combination of form fit and ratchet means.

Figure 4:
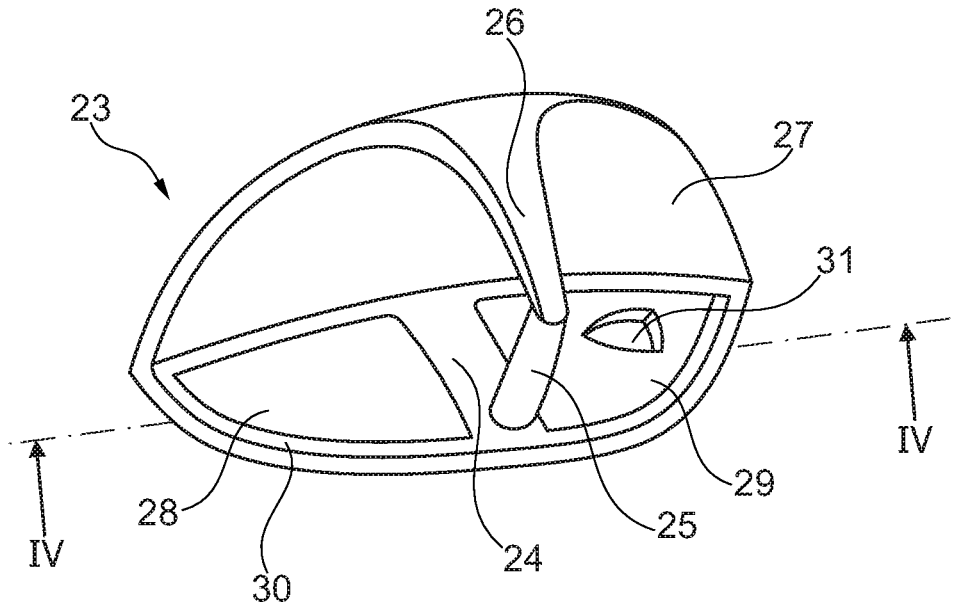

An alternative embodiment of a striker 23 in a three-dimensional view is reproduced in FIG. 4. The striker 23 also has a mounting plate 24 and a locking bolt 25. The construction of the striker 23 shows other geometric embodiments in relation to the locking bolt 25; however, the locking bolt 25 is also attached to a strut 26 on a splay 27.

The cover caps 28, 29 are circumferentially inserted flush into the surface 30 of the mounting plate 24. A depression 31 is provided for accommodation of a symbol, for example, in the cover cap 29. By means of the depression 31 it is possible to attach a symbol flush with the cover cap 29 in the striker 23.

Figure 5:
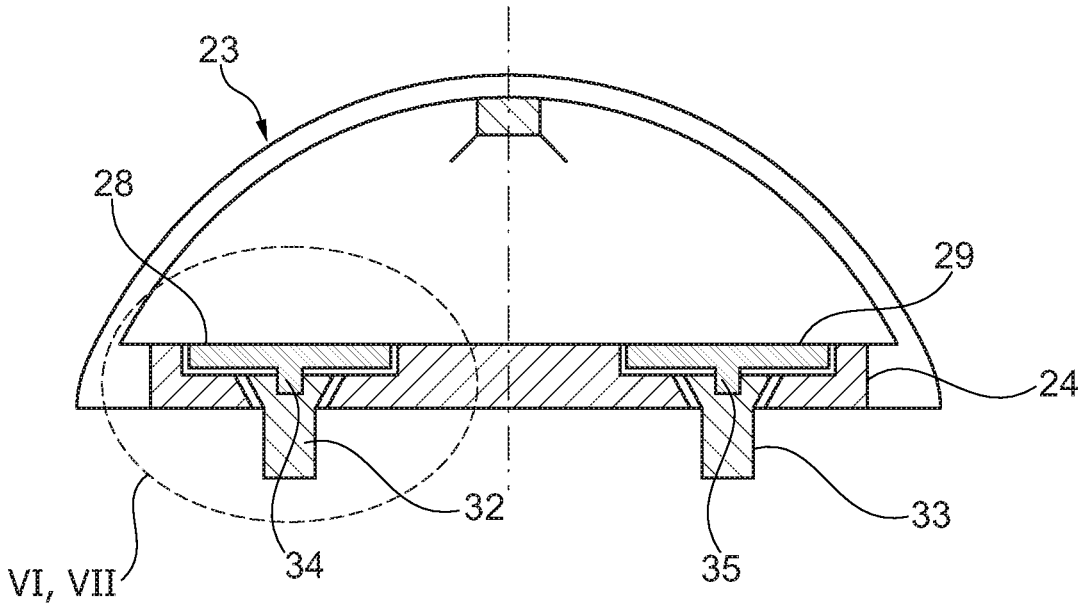
Figure 6:
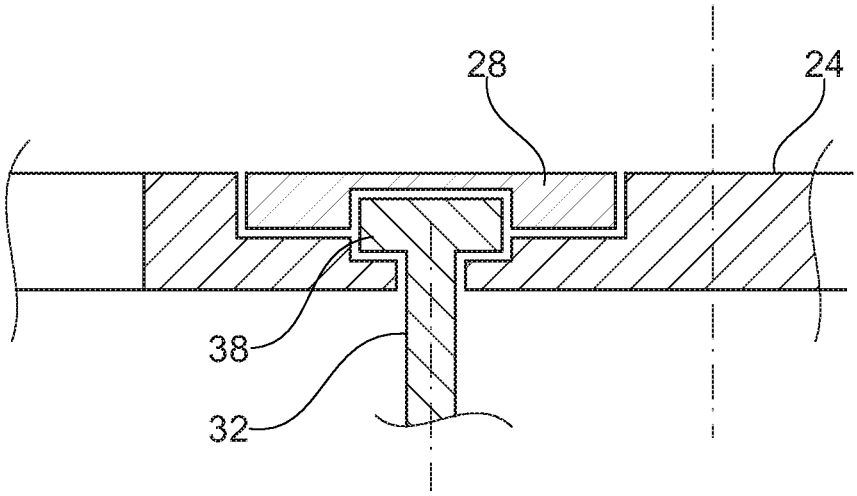
Figure 7:
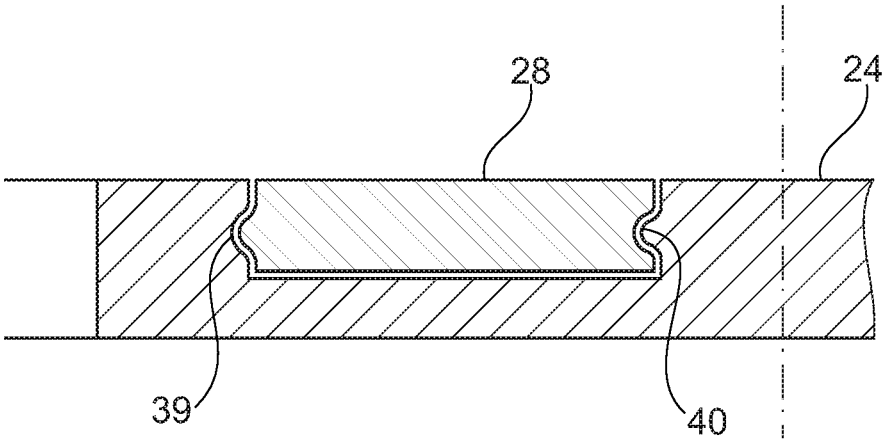

In order to explain the attachment of the cover caps 28, 29 in the striker 23 in FIGS. 5, 6 and 7 alternative attachment methods of the cover cap 28, 29 are reproduced as an example.

FIG. 5 shows a cut along line V-V from FIG. 4. The striker 23 with the attachment means 32, 33 is illustrated, whereby the attachment means 32, 33 are reproduced as countersunk screws with an internal hex. The cover caps 28, 29 are accommodated in the mounting plate 24 in a flush and form-fitting manner. In addition, the cover caps 28, 29 have extensions 34, 35 which reach into the attachment means 32, 33. The cover caps 28, 29 are thus held by means of a form fit in the mounting plate 24 and the attachment means 32, 33 in the striker 23.

FIG. 6 shows a detailed view according to VI from FIG. 5. The area concurring with FIG. 5 is illustrated in FIG. 6 but with an alternative solution to attach the cover 28. The cover cap 21 is in turn inserted into the mounting plate 24 in a flush and form-fitting manner and also connected in a form-fitting manner with a screw head 38 of an attachment means 32.

FIG. 7 shows a further alternative embodiment according to a detail VII from FIG. 5, whereby the cover cap 28 is held by means of ratchet means in the mounting plate 24. It is pointed out again that the exemplary embodiments illustrated in the Figures only constitute examples which can have different and also combined, alternative forms of the attachment of the cover caps 4, 5, 28, 29 according to the formation of the striker 1, 23 and the mounting plate 2, 24.

LIST OF REFERENCE SYMBOLS

1 Striker
2 Mounting plate
3 Locking bolt
4 First cover cap
5 Second cover cap
6 Depression
7 Splay
8 Strut
9 Surface of the mounting plate
10, 11, 12, 13, 14 Peripheral area
15 Strokes
16, 17 Mounting openings
18, 19 Surface of the cover caps
20 Undercut
21 Welt
22 Ratchet means
23 Striker
24 Mounting plate
25 Locking bolt
26 Strut
28, 29 Cover cap
30 Surface of the mounting plate
31 Depression
32, 33 Attachment means
34, 35 Extensions
36, 37 Hex
38 Screw head
39, 40 Ratchet means
L Line

The invention claimed is:

1. A striker for a motor vehicle latch, the striker comprising:

a locking bolt, a mounting plate, and a cover cap, wherein the mounting plate is configured to be attached to a motor vehicle by an attachment screw and the locking bolt is mounted to the mounting plate, wherein the mounting plate defines a receptacle configured to receive the cover cap such that the cover cap forms a substantially flushed surface area with the mounting plate, wherein the cover cap is attached to the attachment screw by an interlocking connection, wherein the cover cap has a depression formed in a surface of the cover cap that forms the surface area with the mounting plate, wherein the depression is formed relative to the surface area for accommodating a sign or logo, and wherein the receptacle defines a protrusion extending from a bottom surface of the receptacle and configured to engage with a depression formed on the cover cap in order to prevent movement of the cover cap with respect to the mounting plate.

2. The striker according to claim 1, wherein the cover cap ends flush with a surface area of the mounting plate at least in part.

3. The striker according to claim 1, wherein the cover cap ends fully flush with a surface area of the mounting plate.

4. The striker according to claim 1, wherein the cover cap can be connected to the attachment screw in a form-fitting and/or force-fitting manner.

5. The striker according to claim 4, wherein the cover cap can be inserted into the attachment screw.

6. The striker according to claim 1, wherein the cover cap can be connected to the mounting plate in a form-fitting and/or force-fitting manner.

7. The striker according to claim 1, wherein the cover cap can be slid and/or clipped and/or ratcheted into the mounting plate.

8. The striker according to claim 1, wherein the striker is made of chrome steel and/or chrome-plated steel and the cover cap is made of plastic.

9. The striker, wherein the striker has two cover caps arranged symmetrically.

10. The striker according to claim 1, wherein the cover cap forms a peripheral area of the striker at least in places.

11. The striker according to claim 1, wherein the cover cap forms an integral component of the striker so that the cover cap forms a uniform surface in interplay with the mounting plate.

12. The striker according to claim 1, wherein the cover cap has a metallic surface and/or a surface with a metallic appearance at least in places.

13. The striker according to claim 1, wherein the receptacle includes an undercut and the cover cap includes a complementary profile that engages the undercut to secure the cover cap in the mounting plate.

14. The striker according to claim 1, wherein the first interlocking feature and the second interlocking feature are semi-spherical in shape.

15. A striker for a motor vehicle latch, the striker comprising:

a locking bolt, a mounting plate, and a cover cap, wherein the mounting plate is configured to be attached to a motor vehicle chassis by an attachment screw and the locking bolt is mounted to the mounting plate, wherein the mounting plate defines a receptacle configured to receive the cover cap such that the cover cap forms a substantially flushed surface area with the mounting plate, and wherein the receptacle defines opposed sidewalls, one of the sidewalls having a first protrusion and the other sidewall defining a first depression, and the cover cap defines a second protrusion at one side and a second depression at an opposed side, in order to securely mount the cover plate within the receptacle.

16. The striker according to claim 15, wherein the first protrusion, the second protrusion, the first depression, and the second depression each have a semi-spherical shape.

17. The striker according to claim 15, wherein the mounting plate has a mounting opening for receiving a screw to attach the striker to the motor vehicle chassis, and wherein the cover cap extends over the mounting opening to cover the mounting opening.

* * * * *